US006076188A

United States Patent [19]

Dresen et al.

[11] Patent Number: 6,076,188

[45] Date of Patent: Jun. 20, 2000

[54] NECKTIE

[76] Inventors: Birgit Dresen; Gernot Lenz, both of Alte Bonnstr. 157 b, Brühl, Germany, D-50321

[21] Appl. No.: 09/365,323

[22] Filed: Jul. 30, 1999

Related U.S. Application Data

[63] Continuation of application No. PCT/DE98/00140, Jan. 16, 1998.

[30] Foreign Application Priority Data

Jan. 30, 1997 [DE] Germany ..... 297 01 526

[51] Int. Cl.[7] ..... A41D 25/04

[52] U.S. Cl. ..... 2/145; 2/144

[58] Field of Search ..... 2/144, 209.3, 279, 2/145, 146; D2/605; 24/49.1; D11/202

[56] References Cited

U.S. PATENT DOCUMENTS

| | | | |
|---|---|---|---|
| D. 45,278 | 2/1914 | Waitzfelder | 2/144 |
| 320,386 | 6/1885 | Noar | 2/144 |
| 1,540,136 | 6/1925 | Laage | 2/144 |
| 1,724,659 | 8/1929 | Johnston | 2/144 |
| 2,301,261 | 11/1942 | Diehl et al. | 139/384 |
| 2,692,387 | 10/1954 | Spaniol | 2/144 |
| 3,439,360 | 4/1969 | Grubman | 2/144 |
| 3,622,426 | 11/1971 | Kuuleiilunal et al. . | |
| 3,639,916 | 2/1972 | Vaughn | 2/130 |
| 3,778,847 | 12/1973 | Lundin . | |
| 4,627,113 | 12/1986 | Lord | 2/144 |
| 4,875,239 | 10/1989 | Patterson, Jr. | 2/153 |
| 5,416,925 | 5/1995 | Scott . | |
| 5,546,603 | 8/1996 | Lawhorn et al. . | |
| 5,600,851 | 2/1997 | McLeod | 2/144 |

FOREIGN PATENT DOCUMENTS

| | | |
|---|---|---|
| 389630 | 1/1990 | Austria . |
| 9428748 | 12/1994 | WIPO . |

*Primary Examiner*—John J. Calvert
*Assistant Examiner*—Alissa L. Hoey
*Attorney, Agent, or Firm*—Thomas R. Vigil

[57] ABSTRACT

The invention relates to a necktie made of leather, textiles or flexible material with a collar for fastening the tie around the neck and a front apron fitted to the collar, whereby the front apron (5) is made of at least three braided bands (2, 3, 4).

6 Claims, 3 Drawing Sheets

NECKTIE

CROSS-REFERENCE TO RELATED APPLICATIONS

This application is a continuation of PCT application No. PCT/DE 98/00140 filed Jan. 16, 1998 and claims priority from German Application No. 297 01 526.5 filed Jan. 30, 1997.

BACKGROUND OF THE INVENTION

1. Field of the Invention

The present invention relates to a necktie made of leather or textiles with a collar for fastening the tie around the neck and a front apron fitted to the collar.

2. Description of the Prior Art

Neckties are mainly used by men as an ornament and are comprising a longish band that is narrow in its upper area and that is widening downwards. The narrow part of the necktie is tied around the neck and serves as a collar, whereas the two ends are tied together in such a way that is the lower, wider part is coming out of the knot and is constituting the so-called front apron. Such neckties are used as an ornament and should therefore always be fashionable and constitute a particular eye-catcher.

SUMMARY OF THE INVENTION

The object of the present invention is therefor to provide a particularly extravagant necktie that catches the eye.

The solution of this object according to the invention is to develop the necktie mentioned above so that the front apron is made of at least three braided bands.

A necktie designed according to this technical teaching presents the advantage that the front apron is gaining three-dimensional depth by the interlacing and is thus catching the eye of the observer.

The front apron is braided from top to bottom which makes it more easy to handle. An esthetic particuliarity of the necktie according to the invention is that the front apron is tapered downwards.

In a preferred embodiment, the necktie is composed of at least three bands, at least two of which are emerging of the upper part of the front apron and are constituting the collar.

The advantage thereof is that the whole necktie comprises only for example three bands and that it is easy to manufacture. The handling of this necktie is also easy, since the two emerging bands only need to be placed around the neck and linked together on their free ends by means of a press-button, a Velcro-fastener or a hook. The tedious tying of a knot which is usual with ordinary neckties is no more necessary and the necktie may be put on or taken off in a fast way.

In another preferred embodiment, the front apron is braided out of three already braided bands. A double interlacing arrangement is thus achieved that is giving the necktie a particular esthetic effect and a double three-dimensional depth.

In another, preferred embodiment, the necktie is braided in horizontal direction in the area of the collar above the front apron whereas the actual, vertically braided front apron is attached to the horizontally braided part. Such a necktie is particularly esthetic.

In still another preferred embodiment, the front apron is tapering to a point in its lower free end, whereas the point may alternatively be arranged on the center or off-center. In another embodiment, the point may be frayed or irregular.

In a preferred development, the necktie is provided with ornaments such as globules, spangles, small pictures or the like, in order to still further embellish the necktie and to provide the possibility of further, individual creations.

In another, preferred embodiment, the necktie is provided with several recesses that are reinforced by hole strengthening means as it is usual with an eye. Adornments may then be hooked into these eye-like holes or other bands or the like may be passed through them so that the whole necktie is even more embellished.

Further advantages of the necktie according to the invention will become clear in the description and in the enclosed drawing. The previously mentioned characteristics and those cited below may be used either individually or in any combination according to the invention. The embodiments mentioned are only examples and are not limiting the scope of the invention. The drawing is showing neckties according to the invention by means of which the invention is explained in more details. The drawing shows in

DESCRIPTION OF THE PREFERRED EMBODIMENT(S)

Figure 1:
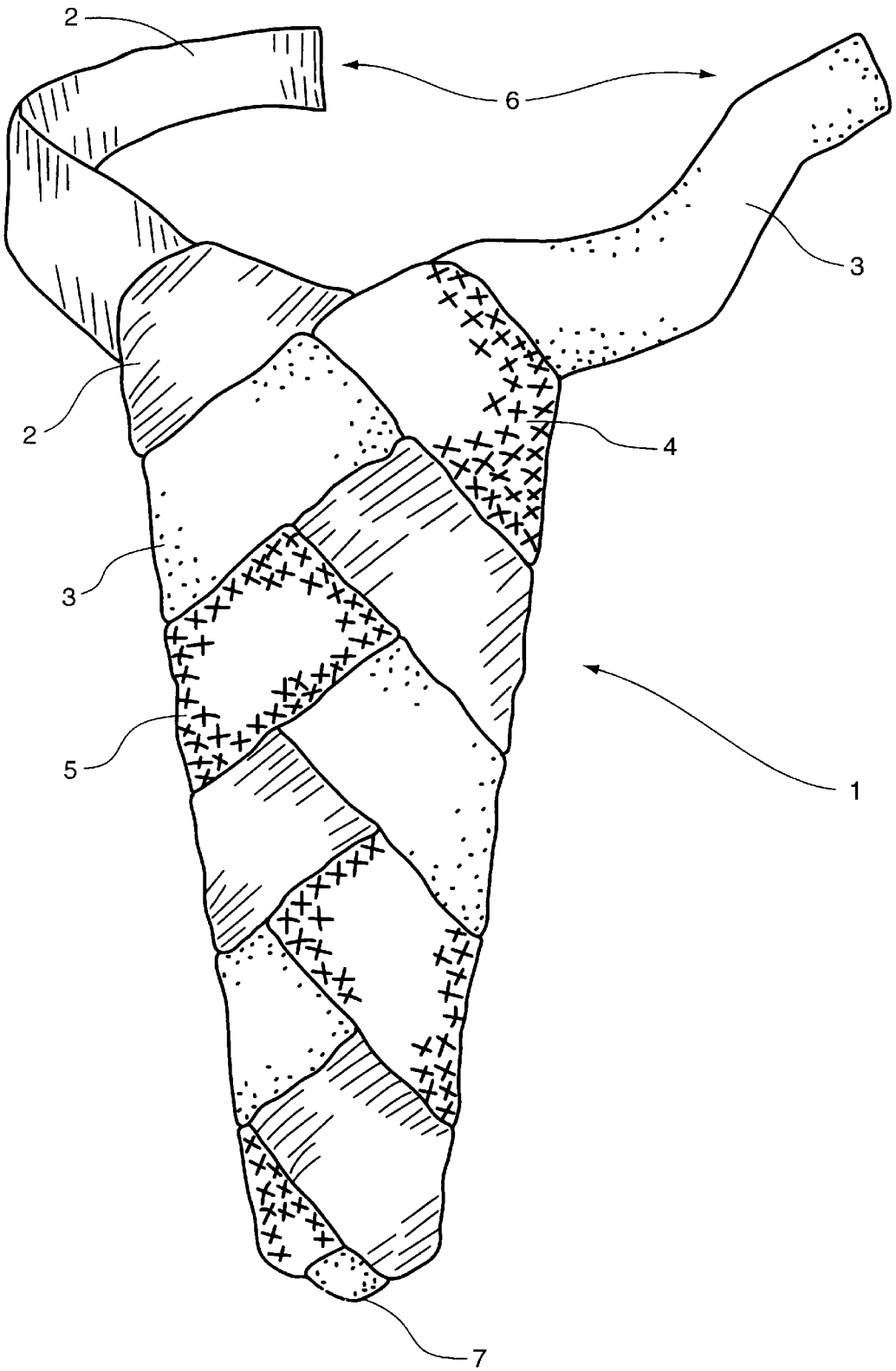
FIG. 1 is a first embodiment of a necktie according to the invention.

FIG. 1 shows a front view of an already braided necktie 1 according to the invention comprising three bands 2, 3, 4. These bands have different aspects, whereas band 2 is provided with straight lines, band 3 with dots and band with crosses. In this embodiment, only the front apron 5 is braided, whereas the collar 6 is made of the bands 2 and 3.

The bands 2 and 3 are emerging on either side of the upper edge of the front apron 5 of the braided area and are long enough to be placed around the neck. The bands 2 and 3 are then linked together on the rear side of the neck by means of a non-illustrated press-button, Velcro-fastener or hook.

The front apron 5 is braided from top to bottom and is thicker in its upper area than in its lower area. In another embodiment not shown, the front apron has the same width over its whole length. This front apron 5 is tapering to a point in its narrow, lower area, whereas the point 7 is placed centrally.

Figure 2:
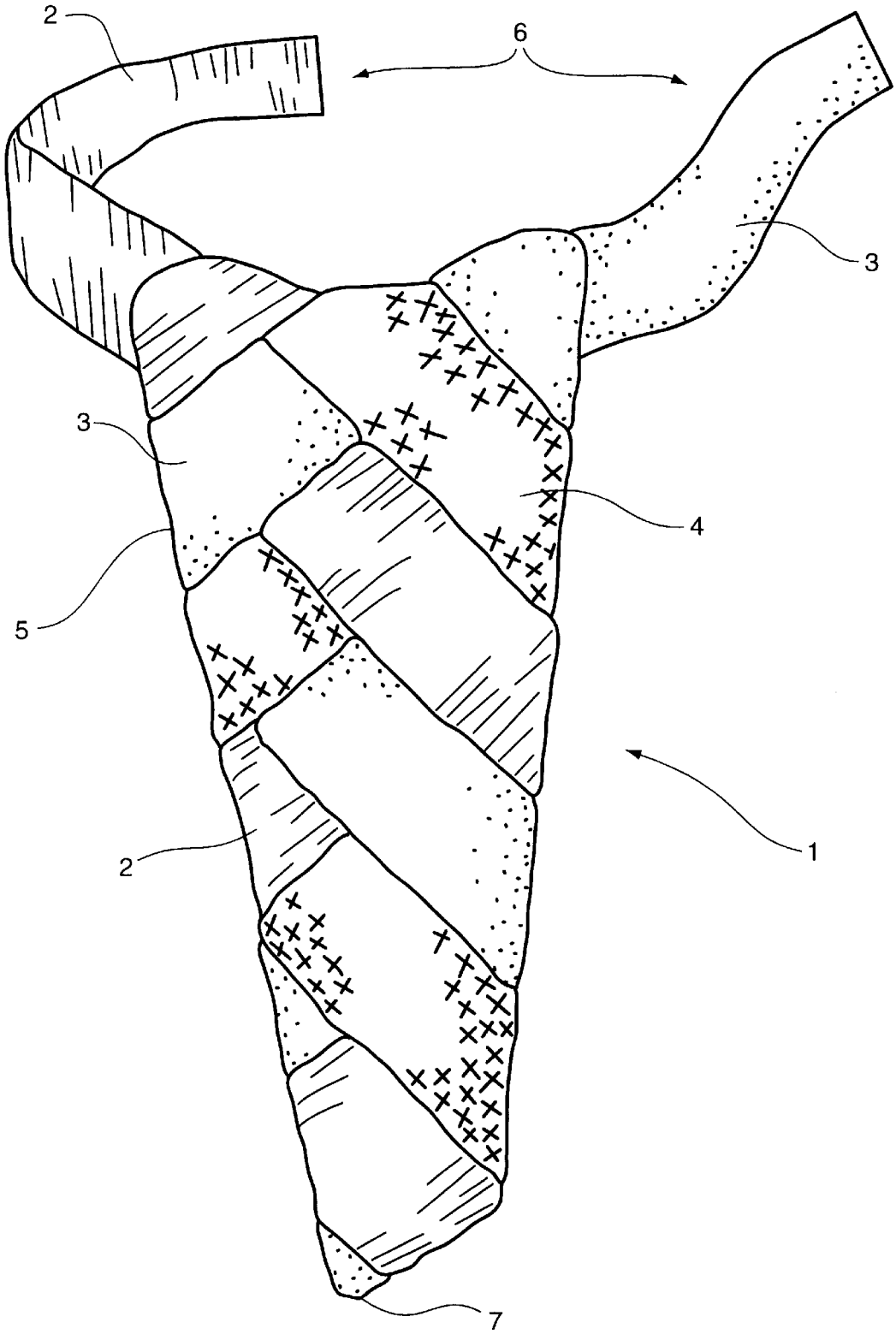
FIG. 2 is a second embodiment of a necktie according to the invention.

The second embodiment of a necktie 1 according to the invention and shown in FIG. 2 is differing from the first embodiment shown in FIG. 1 by the unique fact that here the point 7 is not placed centrally but off-center. The point 7 is placed off-center by shifting the center of the braided front apron 5 to the left (see FIG. 2) or alternatively to the right while manufacturing the necktie 1. Thus the surfaces are getting bigger on the other side of the point 7.

In FIGS. 1 and 2, the front apron 5 simultaneously constitutes the central part of the collar 6, that's to say the visible part between the two collar points.

Figure 3:
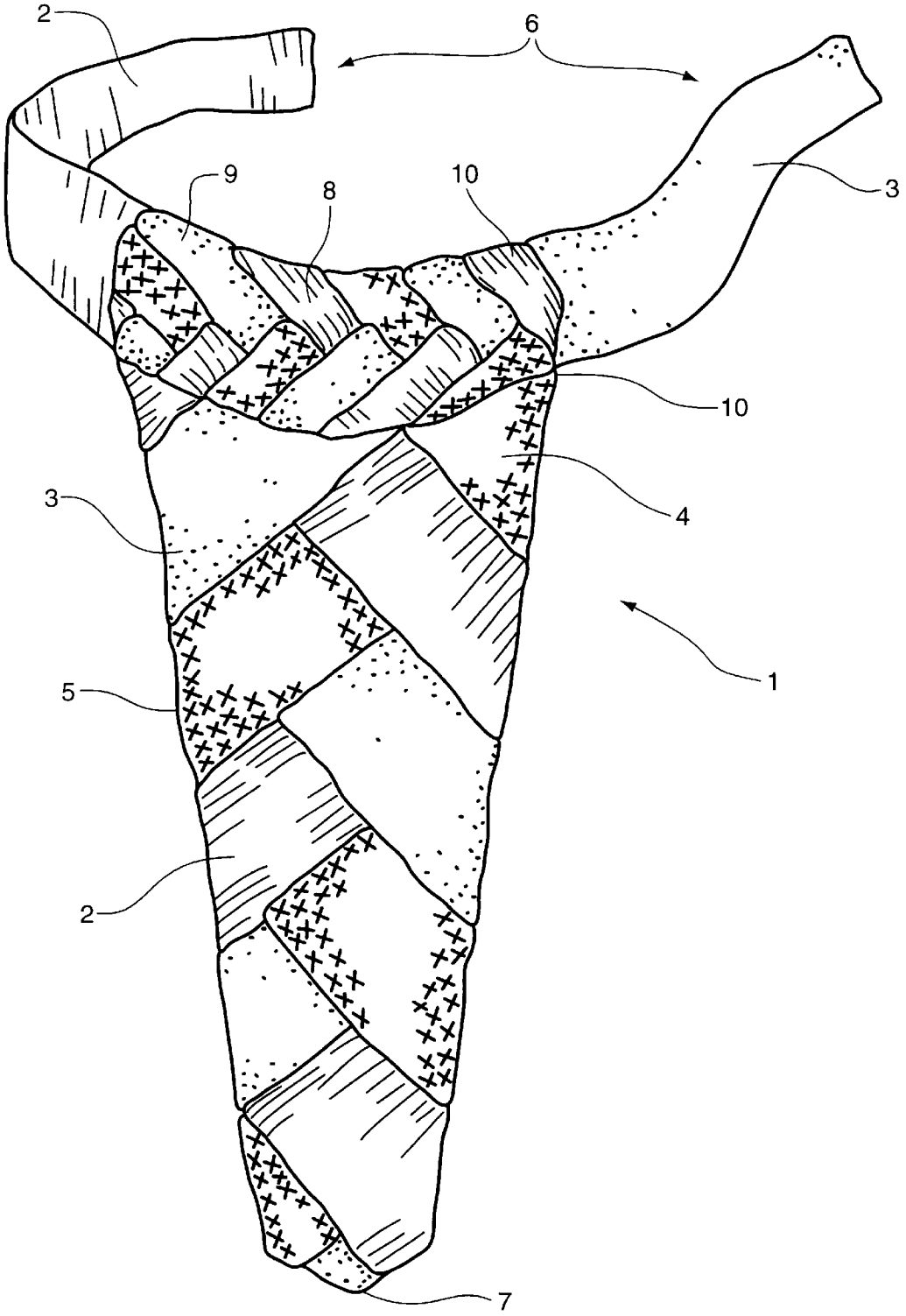
FIG. 3 is a third embodiment of a necktie according to the invention.

The third embodiment of the necktie according to the invention is shown in FIG. 3. It only differs from the first embodiment shown in FIG. 1 by an additional horizontally braided band 8 arranged in prolongation of the collar 6 in the area of the front apron 5. This band 8 is also made of three bands 9, 10 and 11, whereas these bands 9, 10 and 11 are narrower than the main bands 2, 3 and 4.

In other not shown embodiments, the bands 2, 3, 4, 9, 10, 11 may themselves consist of broided bands, so that the necktie gets the appearance of having been double-braided.

In still another embodiment, the necktie is provided with spangles, globules, small pictures or the like accessories that are confering a particular individual fascination on the necktie.

In the embodiments shown, the necktie is braided by means of the plait technique (the technique is the same as for the hair plaits). The band lying undermost and farthest outside is placed above the inner band, whereas the right band is alternating with the left band. The same is true for the broided band. In other embodiments, other interlacing techniques like for example the spicular technique are possible.

In another embodiment not shown the single bands are braided. The weaving pattern thus obtained is very coarse due to the relatively broad bands and small interspaces may appear between the single bands.

I claim:

1. A necktie having a top and a bottom and being made from at least first and second elongate bands of leather, textile or other flexible material;

each band of material having an upper free end portion which extends outwardly from said top of said necktie and each band of material extending downwardly from said top of said necktie and being interlaced with at least one other band to form braiding of the bands of material downwardly to said bottom of said necktie, each said upper end portion of said first and second bands having fastening means adjacent an outer free end thereof, and said upper end portions form a collar for fastening said necktie around the neck of a wearer and are constructed and arranged to be fastened together with said fastening means about the neck of the wearer.

2. The necktie of claim 1 wherein said interlaced bands of said necktie form a front apron of said necktie and said front apron tapers from a wider upper portion of said necktie at said top of said necktie to a narrower lower portion at said bottom of said necktie.

3. The necktie of claim 1 wherein said front apron of said necktie tapers to a point at said bottom which is located in one of a center or off center position.

4. The necktie of claim 1 including at least one ornament attached to said front apron, said ornament comprising one of a globule, a spangle, a small picture, a straight band, a screwed band or a loop.

5. The necktie of claim 1 including holding means on said front apron for holding at least one ornament.

6. The necktie of claim 1 wherein said fastening means comprises one of snap button fastening means, hook and loop fastening means, or catch and hook fastening means.

* * * * *